US007671715B2

(12) United States Patent
Iwase

(10) Patent No.: US 7,671,715 B2
(45) Date of Patent: Mar. 2, 2010

(54) MAGNETIC ELEMENT AND METHOD FOR MANUFACTURING THE SAME

(75) Inventor: Masayuki Iwase, Tsukuba-gun (JP)

(73) Assignee: Sumida Corporation (JP)

( * ) Notice: Subject to any disclaimer, the term of this patent is extended or adjusted under 35 U.S.C. 154(b) by 138 days.

(21) Appl. No.: 11/177,116

(22) Filed: Jul. 8, 2005

(65) Prior Publication Data

US 2006/0006973 A1 Jan. 12, 2006

(30) Foreign Application Priority Data

Jul. 8, 2004 (JP) ..... 2004-201426

(51) Int. Cl.
*H01F 5/00* (2006.01)

(52) U.S. Cl. ..... 336/200

(58) Field of Classification Search ..... 336/200
See application file for complete search history.

(56) References Cited

U.S. PATENT DOCUMENTS 6,606,022 B1 * 8/2003 Taurand ..... 336/200
6,839,955 B2 * 1/2005 Uchikoba et al. ..... 29/602.1
2004/0207488 A1 * 10/2004 Kono et al. ..... 333/185

FOREIGN PATENT DOCUMENTS

| | | |
|---|---|---|
| CN | 1405799 | 3/2003 |
| JP | 10-335144 | 12/1998 |
| JP | 2001-267129 | 9/2001 |

* cited by examiner

*Primary Examiner*—Lincoln Donovan
*Assistant Examiner*—Joselito Baisa
(74) *Attorney, Agent, or Firm*—Stephen Chin; von Simson & Chin LLP

(57) ABSTRACT

A magnetic element having an excellent direct-current saturation characteristic by effectively utilizing a size of a core is provided. The magnetic element has cores 11, 7, 8 and 17 formed of a magnetic material, buried conductor parts 21, 31 and 41 in the magnetic material, and a plurality of branch conductor parts 22, 23, 34, 35, 36, 37, 42 and 43 branching from the buried conductor parts 21, 31 and 41 to be a plurality of parts and separately turning around the magnetic material.

7 Claims, 12 Drawing Sheets

MAGNETIC ELEMENT AND METHOD FOR MANUFACTURING THE SAME

BACKGROUND OF THE INVENTION

1. Field of the Invention

The present invention relates to a magnetic element and a method for manufacturing the same.

2. Description of the Related Art

In magnetic elements, those with winding-wires wound around bobbins made of a magnetic material are widely known. Compactness and high integration are demanded of an electronic circuit. Therefore, in the magnetic elements, those more compact with high performance are demanded.

Japanese Patent Application Laid-open No. 2001-267129 (Abstract, Drawings and the like) discloses a chip inductor in which a spiral coil conductor is formed in an intermediate, and a core is inserted into a through-hole provided in a central portion of this coil conductor. Japanese Patent Application Laid-open No. 10-335144 (Abstract, Drawings and the like) discloses a stacked-type inductance element provided with a spiral conductor coil folded back into at least two or more in a magnetic substance or nonmagnetic substance. In these conventional magnetic elements, a winding-wire is buried in a magnetic material or a non-magnetic material. Therefore, in these conventional magnetic elements, it is possible to achieve compactness more than the magnetic element of the structure in which the wiring-wire is wound around the bobbin, by utilizing a winding-wire with a sectional area which is too fine to be wound around a bobbin, and the like, However, in the case of the magnetic element with the structure in which the winding-wire is buried in the core, the characteristics such as a direct-current saturation characteristic is sometimes unfavorable as compared with the magnetic element with the structure in which a winding-wire is wound around the bobbin. Therefore, in the magnetic elements with the structure in which the winding-wires are buried in the cores, improvement in the characteristics such as the direct-current saturation characteristic is required.

SUMMARY OF THE INVENTION

An object of the present invention is to provide a magnetic element having an excellent direct-current saturation characteristic by effectively utilizing a size of a core. Another object of the present invention is to provide a manufacturing method which is suitable for manufacture of the magnetic element having the excellent direct-current saturation characteristic by effectively utilizing the size of the core.

A magnetic element according to the present invention has a core formed of a magnetic material, a buried conductor part in the magnetic material, and a plurality of branch conductor parts branching from the buried conductor part to be a plurality of parts and turning around the magnetic material.

By adopting this construction, the limited size of the core is effectively utilized and the thickness of the core can be secured over the entire periphery around the buried conductor part. The buried conductor part can be placed in the middle of the core, for example. Since such a thick core is formed over the entire periphery around the buried conductor part, the magnetic flux by the electric current flowing in the buried conductor part is difficult to saturate in the core. As a result, in a core of a smaller size, an excellent direct-current saturation characteristic with which the inductance value is difficult to decrease even if a larger direct current is superimposed can be obtained.

Another magnetic element according to the present invention has a plurality of buried conductor parts layered and arranged, and a plurality of branch conductor parts branching from one of the buried conductor parts, extending to opposite sides from each other while sandwiching the buried conductor part therebetween, each separately turning around a core formed of a magnetic material to connect to another one of the buried conductor parts.

By adopting this construction, the limited size of the core is effectively utilized and the thickness of the magnetic material can be secured over the entire periphery around the buried conductor part. The buried conductor part is layered and arranged. Since such a thick magnetic material is formed over the entire periphery around a plurality of buried conductor parts layered and arranged, the magnetic flux by the electric current flowing in the buried conductor part is difficult to saturate in the magnetic material. As a result, in a core of a smaller size, an excellent direct-current saturation characteristic with which the inductance value is difficult to decrease even if a larger direct current is superimposed can be obtained.

A third magnetic element according to the present invention has a coil main body having a core formed of a magnetic material, a first external electrode placed at the coil main body, a second external electrode placed at the coil main body, and an internal conductor having a buried conductor part buried in the core and a plurality of branch conductor parts branching from the buried conductor part and placed around the buried conductor part, and connecting the first external electrode and the second external electrode so that an electric current flowing between the first external electrode and the second external electrode flows dividedly into the plurality of branch conductor parts from the buried conductor part, or flows unitedly into the buried conductor part from the plurality of branch conductor parts.

By adopting this construction, the limited size of the core is effectively utilized and the thickness of the core can be secured over the entire periphery around the buried conductor part. The buried conductor part can be placed in the middle of the core, for example. Since such a thick core is formed over the entire periphery around the buried conductor part, the magnetic flux by the electric current flowing in the buried conductor part is difficult to saturate in the core. As a result, in a core of a smaller size, an excellent direct-current saturation characteristic with which the inductance value is difficult to decrease even if a larger direct current is superimposed can be obtained.

A fourth magnetic element according to the present invention has a coil main body having a core formed of a magnetic material, a first external electrode placed at the coil main body, a second external electrode placed at the coil main body, and an internal conductor having a buried conductor part buried in the core and two of branch conductor parts branching from the buried conductor part and placed around the buried conductor part, and connecting the first external electrode and the second external electrode so that an electric current flowing between the first external electrode and the second external electrode flows dividedly into the two of branch conductor parts from the buried conductor part, or flows unitedly into the buried conductor part from the two of branch conductor parts.

By adopting this construction, the limited size of the core is effectively utilized and the thickness of the core can be secured over the entire periphery around the buried conductor part. The buried conductor part can be placed in the middle of the core, for example. Since such a thick core is formed over the entire periphery around the buried conductor part, the magnetic flux by the electric current flowing in the buried conductor part is difficult to saturate in the core. As a result, in a core of a smaller size, an excellent direct-current saturation characteristic with which the inductance value is difficult to decrease even if a larger direct current is superimposed can be obtained.

In addition to the construction of each of the above described invention, the magnetic element according to the present invention has a nonmagnetic gap part formed of a nonmagnetic material, placed in contact with at least a part of the internal conductor, and formed along a direction in which the buried conductor part and the two branch conductor parts are arranged so as to intersect a magnetic flux generated by the coil main body.

By adopting this construction, the nonmagnetic gap part is formed in the direction perpendicular to the direction in which the magnetic flux turns so as to divide the magnetic flux formed in the core, in other words, to cut off the magnetic path formed in the core, and therefore, the core can be restrained from being in the magnetic saturation state.

In addition to the construction of each of the above described invention, in the magnetic element according to the present invention, the internal conductor forms a spiral of a conductor in the coil main body by having at least two of at least ones of the buried conductor part and the two branch conductor parts, and has a nonmagnetic inter-conductor nonmagnetic part placed between conductors that are parallel in the spiral.

By adopting this construction, even when the internal conductor forms the spiral, a closed magnetic flux can be prevented from occurring to the core between the conductors overlaid on each other in the spiral (so-called short pass).

In addition to the construction of each of the above described invention, in the magnetic element according to the present invention, the branch conductor part is exposed at a surface of the core.

By adopting this construction, the branch conductor part is exposed at the surface of the core, and therefore, the magnetic lines of force by the electric current flowing in the branch conductor part do not close in the core. Therefore, it is estimated to be difficult for the magnetic flux density by the electric current flowing in the branch conductor part to be high in the core. The electric current which can be passed into the buried conductor part until the core is saturated increases correspondingly, and thus, more excellent direct-current saturation characteristic with which a high inductance value can be maintained even if a larger direct current is superimposed can be obtained.

Further, by adopting this construction, the magnetic flux structure in the core by the electric current flowing in the branch conductor part is simplified, and therefore, the actual measurement value close to the inductance value which is calculated based on the size of the core at the inner side of the branch conductor part can be obtained. As a result, the correcting operation for matching the inductance value with a desired value is facilitated, and design of the magnetic element is facilitated.

In addition to the construction of each of the above described invention, in the magnetic element according to the present invention, a region exposed at the surface of the core, of the branch conductor part is covered with a nonmagnetic or nonconductive material.

By adopting this construction, the magnetic lines of force by the electric current flowing in the branch conductor part is not closed in the magnetic material, and solder and the other conductive materials can be prevented from attaching to and contacting the branch conductor part exposed at the surface of the core.

In addition to the construction of each of the above described invention, in the magnetic element according to the present invention, the coil main body and the core are formed into long shapes which are long in a same direction, and the first external electrode and the second external electrode are placed at both end portions in a long side direction of the coil main body, and the buried conductor part is placed along a long side direction of the core.

By adopting this construction, the length of the buried conductor part covered with the core becomes long, self-inductance action in the buried conductor part by the core is enhanced, and the inductance value of the magnetic element becomes large.

In addition to the construction of each of the above described invention, in the magnetic element according to the present invention, one end portion of the internal conductor is connected to the first external electrode, and the other end portion of the internal conductor is connected to the second external electrode, and the magnetic element has a nonmagnetic part formed of a nonmagnetic material placed so that a coil portion of the internal conductor is exposed at a surface of the core, between the coil portion by the internal conductor and the first external electrode and/or between the coil portion by the internal conductor and the second external electrode.

By adopting this construction, even with the structure in which the first external electrode and the second external electrode are placed at both end portions in the long side direction of the coil main body, the magnetic lines of force, which occur to the coil by the electric current flowing in the vicinity of the first external electrode or the second external electrode, passes through the nonmagnetic part, and do not close in the core. Therefore, it is estimated to be difficult for the magnetic flux density by the electric current flowing in the vicinity of the first external electrode or the second external electrode to be high in the core. The electric current, which can be passed into the buried conductor part until the core is saturated, increases correspondingly, and a more excellent direct-current saturation characteristic with which a high inductance value can be maintained even when a larger direct current is superimposed can be obtained.

Further, by adopting this construction, it is estimated to be difficult for the magnetic flux density in the core by the electric current flowing in the vicinity of the first external electrode or the second external electrode to be high, and therefore, the actual measurement value close to the inductance value which is calculated based on the size of the core at the inner side of the branch conductor part can be obtained. As a result, the correcting operation for matching the inductance value with a desired value is facilitated, and design of the magnetic element is facilitated.

In addition to the construction of each of the above described invention, in the magnetic element according to the present invention, a width of the buried conductor part is a width that is widths of the plurality or two of branch conductor parts being added, or more.

By adopting this construction, as the width of the buried conductor part, the width which is the widths of a plurality or two of the branch conductor parts added or more can be ensured. By this, the resistance value of the buried conductor part can be lowered. In addition, even if the buried conductor part is formed to be wide, the thick core is placed around the buried conductor part, and therefore, there is less influence on the direct-current saturation characteristic and the like. Accordingly, while a favorable direct-current saturation characteristic is secured, the direct current resistance value of the magnetic element can be lowered, and the thickness of the magnetic element can be formed to be thin by forming the thickness of the buried conductor part and the branch conductor part to be thin.

Further, as a result that the thickness of the buried conductor part and the branch conductor part becomes thin, increase in the thickness of the magnetic element is suppressed when the number of turns of coil is increased, and when the conductive material and the magnetic material which become the internal conductor are alternately printed on the green sheet of the magnetic material, asperities on the printed surface due to the thickness of the previously printed internal conductor are decreased to make it possible to effectively suppress breakage in the internal part of the core of the internal conductor to be newly printed.

In addition to the construction of each of the above described invention, in the magnetic element according to the present invention, a region exposed at the surface of the core, of the branch conductor part is covered with a nonmagnetic and nonconductive material, and a width of the buried conductor part is a width that is widths of the plurality or two of branch conductor parts being added, or more.

By adopting this construction, the magnetic lines of force by the electric current flowing in the branch conductor part is not closed in the magnetic material, and solder and the other conductive materials can be prevented from attaching to and contacting the branch conductor part exposed at the surface of the core, and as the width of the buried conductor part, the width which is the widths of a plurality or two of the branch conductor parts added or more can be ensured. Thereby, the resistance value of the buried conductor part can be lowered.

In addition to the construction of each of the above described invention, in the magnetic element according to the present invention, one end portion of the internal conductor is connected to the first external electrode, and the other end of the internal conductor is connected to the second external electrode, the magnetic element has a nonmagnetic part formed of a nonmagnetic material placed so that a coil portion of the internal conductor is exposed at a surface of the core, between the coil portion by the internal conductor and the first external electrode and/or between the coil portion by the internal conductor and the second external electrode, and a width of the buried conductor part is a width that is widths of the plurality or two of branch conductor parts being added, or more.

By adopting this construction, even with the structure in which the first external electrode and the second external electrode are placed at both end portions in the long side direction of the coil main body, the magnetic lines of force, which occur to the coil by the electric current flowing in the vicinity of the first external electrode or the second external electrode, passes through the nonmagnetic part, and do not close in the core. Therefore, it is estimated to be difficult for the magnetic flux density by the electric current flowing in the vicinity of the first external electrode or the second external electrode to be high in the core. The electric current, which can be passed into the buried conductor part until the core is saturated, increases correspondingly, and a more excellent direct-current saturation characteristic with which a high inductance value can be maintained even when a larger direct current is superimposed can be obtained. As the width of the buried conductor part, the width which is the widths of a plurality or two of the branch conductor parts added or more can be ensured, and thereby, the resistance value of the buried conductor part can be lowered.

A method for manufacturing a magnetic element according to the present invention is a method for manufacturing a magnetic element according to each of the above described invention, and has the steps of: printing a conductive material and a magnetic material alternately on a green sheet of a magnetic material in a size in which a plurality of the magnetic elements can be formed, so that the branch conductor parts of the adjacent two magnetic elements are in a state connected by the conductive material; forming green chips by cutting the green sheet, on which the conductive material and the magnetic material are printed, between the branch conductor parts of the adjacent two magnetic elements; and burning each of the green chips.

By manufacturing the magnetic element by this method, the branch conductor part of the magnetic element is always exposed at the surface of the burnt core in the section. Accordingly, the magnetic element exhibits an excellent direct-current saturation characteristic. In addition, a number of magnetic elements can be burnt from one green sheet.

By manufacturing the magnetic element by this method, even if the cut position of the green sheet is deviated, the size of the core at the inner side of the branch conductor part does not change. Accordingly, though a plurality of magnetic elements are formed by cutting one green sheet in this manner, the inductance value of each of the magnetic elements is maintained at the actual measurement value close to the calculated value of the inductance which is obtained based on the size of the core in the coil. As a result, a number of magnetic elements can be produced from one green sheet while suppressing a variation in the inductance value.

In the present invention, an excellent direct-current saturation characteristic is obtained by effectively utilizing the size of the core. In the present invention, a magnetic element having an excellent direct-current saturation characteristic by effectively utilizing the size of the core can be manufactured.

DETAILED DESCRIPTION OF THE PREFERRED EMBODIMENT(S)

Hereinafter, a magnetic element and a method for manufacturing the same according to an embodiment of the present invention will be described based on the drawings. The magnetic element will be described with a surface-mount coil as an inductance element as an example. The manufacturing method of the magnetic element will be explained with a manufacturing method of the surface-mount coil as an example.

Figure 1A:
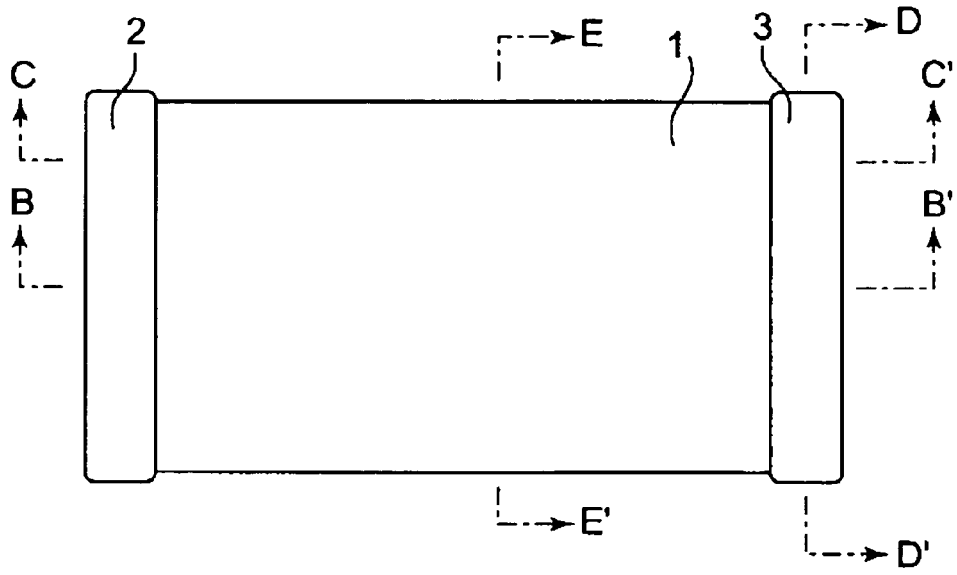
FIG. 1A and 1B are views showing a surface-mount coil according to an embodiment of the present invention.
Figure 1B:
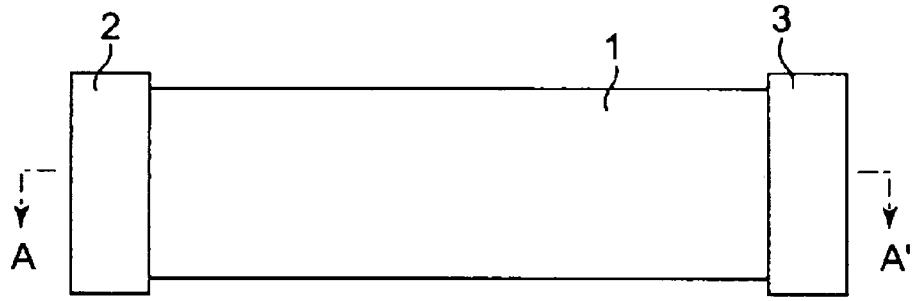

FIGS. 1A and 1B are views showing a surface-mount coil according to an embodiment of the present invention. FIG. 1A is a front view of the surface-mount coil. FIG. 1B is a side view of the surface-mount coil. The surface-mount coil has a coil main body 1. The coil main body 1 has an outer shape in a rectangular parallelpiped shape longer than wide.

This surface-mount coil is used as a power inductor and the like. A power inductor is used as a coil element and the like of a DC/DC converter in, for example, a computer, a digital camera, a video camera, a cellular phone and the like.

A first external electrode 2 is placed at one end portion in a long side direction of the coil main body 1. A second external electrode 3 is placed at the other end portion in the long side direction of the coil main body 1. The first external electrode 2 and the second external electrode 3 are formed of a conductive material. As the conductive material, for example, copper, aluminum, tin, zinc, nickel, alloys of them and the like are cited. The first external electrode 2 and the second external electrode 3 are soldered onto a component mounting surface of a printed-circuit-board, and thereby, the surface-mount coil is mounted on the printed-circuit-board.

Figure 2A:
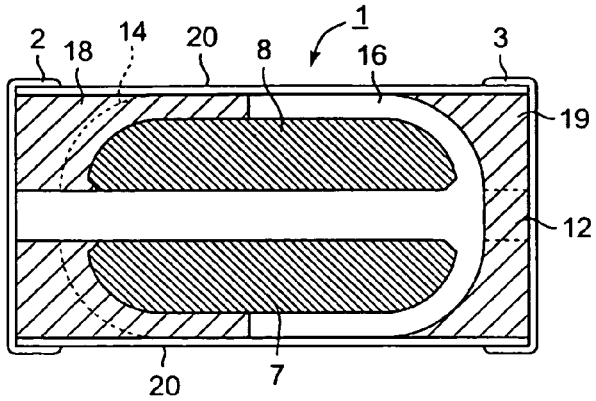
FIGS. 2A, 2B, 2C, 2D and 2E are sectional views showing an internal structure of the surface-mount coil in FIGS. 1A and 1B.
Figure 2B:
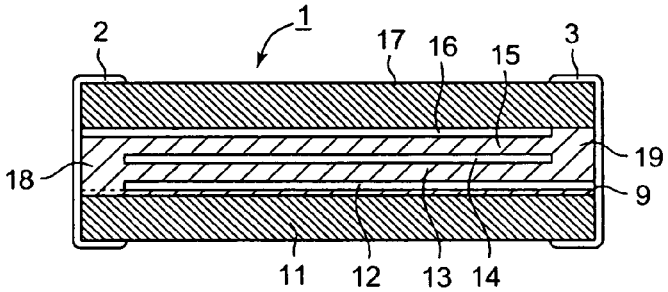
Figure 2C:
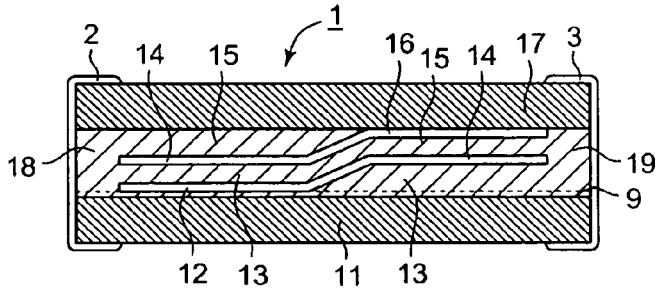
Figure 2D:
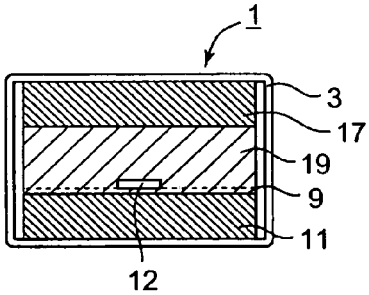
Figure 2E:
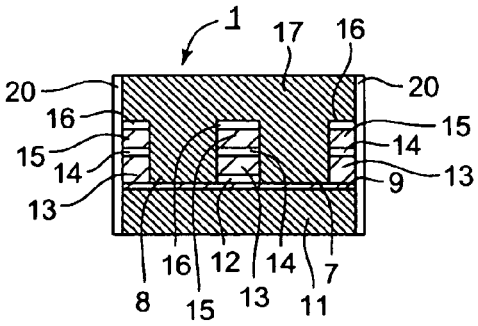

FIGS. 2A to 2E are sectional views showing an internal structure of the surface-mount coil in FIGS. 1A and 1B. FIG. 2A is a cross-sectional view of the surface mount coil when cut along the line A to A' in FIG. 1B. FIG. 2B is a vertical sectional view in a central part in a short side direction of the surface-mount coil when cut along the line B to B' in FIG. 1A. FIG. 2C is a vertical sectional view in a central part in the short side direction of the surface-mount coil when cut along the line C to C' in FIG. 1A. FIG. 2D is a vertical sectional view in an end portion in the long side direction of the surface-mount coil when cut along the line D to D' in FIG. 1A. FIG. 2E is a vertical sectional view in the central part in the long side direction of the surface-mount coil when cut along the line E to E' in FIG. 1A.

The coil main body 1 has a main body substrate 11 as shown in FIGS. 2A to 2E. The main body substrate 11 is formed of a magnetic material such as ferrite. The main body substrate 11 has a rectangular parallelepiped shape longer than wide.

A nonmagnetic gap substance 9 as a nonmagnetic gap part is layered on the main body substrate 11. The nonmagnetic gap substance 9 is layered on an entire surface of the main body substrate 11 in the rectangular parallelepiped shape longer than wide.

The coil main body 1 has a first electric conductor 12, a second electric conductor 14 and a third electric conductor 16, on and above the nonmagnetic gap substance 9 as shown in FIGS. 2A to 2E.

Figure 3:
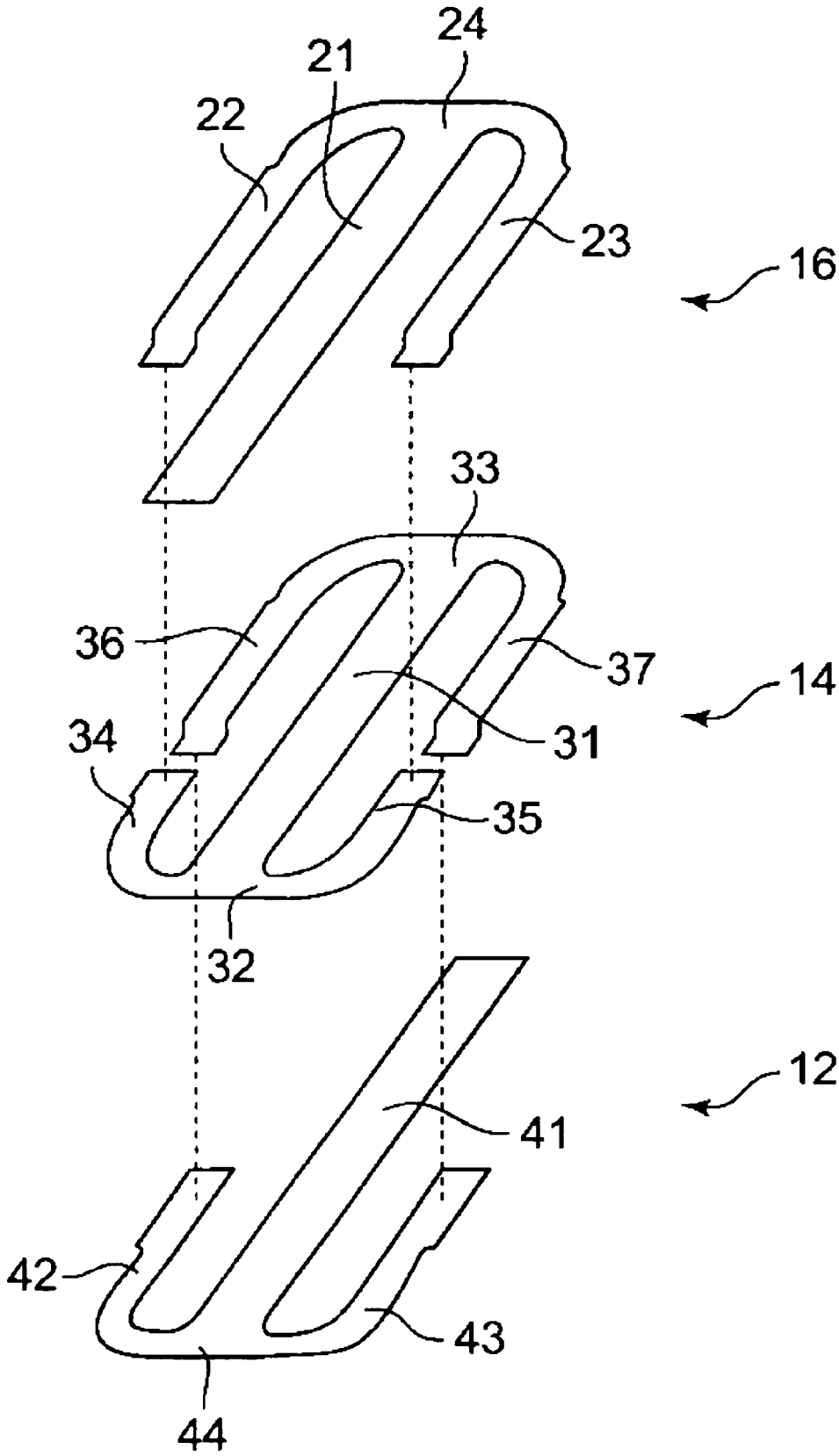
FIG. 3 is a perspective view showing a first electric conductor, a second electric conductor and a third electric conductor formed in a coil main body in FIG. 2.

FIG. 3 is a perspective view showing the first electric conductor 12, the second electric conductor 14 and the third electric conductor 16 which are formed inside the coil main body 1 in FIGS. 2A to 2E. The first electric conductor 12, the second electric conductor 14 and the third electric conductor 16 are formed of silver (Ag), nickel (Ni) and the other conductive materials. An internal conductor is formed by the first electric conductor 12, the second electric conductor 14 and the third electric conductor 16.

In FIG. 3, the third electric conductor 16 which is drawn on the uppermost position has a first buried conductor part 21 as a buried conductor part, a first left branch conductor part 22 as a branch conductor part, a first right branch conductor part 23 as a branch conductor part and a first connecting conductor part 24.

The first buried conductor part 21 has a long rectangular parallelepiped shape. The first connecting conductor part 24 is provided to extend from one end in a long side direction of the first buried conductor part 21. The total length of the first buried conductor part 21 and the first connecting conductor part 24 is shorter than the entire length of the coil main body 1 in the long side direction as shown in FIGS. 2A and 2B. From the first connecting conductor part 24, the first right branch conductor part 23 and the first left branch conductor part 22 are branched to extend. The first right branch conductor part 23 and the first left branch conductor part 22 extend in the opposite directions from each other.

The first right branch conductor part 23 has a shape of a substantially rectangle with one end side curved. The curved portion of the first right branch conductor part 23 extends from the first connecting conductor part 24. A linear portion of the first right branch conductor part 23 is substantially parallel with the long side direction of the first buried conductor part 21. The first left branch conductor part 22 has a shape of a substantially rectangle with one end side in the long side direction curved. The curving direction of the first left branch conductor part 22 is opposite from the curving direction of the first right branch conductor part 23. The curved portion of the first left branch conductor part 22 extends from the first connecting conductor part 24. The linear portion of the first left branch conductor part 22 is substantially parallel with the long side direction of the first buried conductor part 21.

The first right branch conductor part 23 and the first left branch conductor part 22 have the same width. As shown in FIG. 2A, the first buried conductor part 21 has the width which is the result of adding the width of the first right branch conductor part 23 and the width of the first left branch conductor part 22. In each of the first right branch conductor part 23 and the first left branch conductor part 22, the length in the direction along the long side direction of the coil main body 1 is about ⅔ of the length of the first buried conductor part 21.

As a result, the first buried conductor part 21, the first left branch conductor part 22 and the first right branch conductor part 23 are aligned substantially in parallel, and the first left branch conductor part 22 and the first right branch conductor part 23 are provided to extend along both sides of the first buried conductor part 21. Accordingly, the third electric conductor 16 is formed into the shape similar to the anchor of a ship, which is made by bonding "J" of the alphabet and the "J", which is reversed in the lateral direction, back to back. The entire width of the third electric conductor 16 equals the width in the short side direction of the coil main body 1.

Hereinafter, the first left branch conductor part 22, the first connecting conductor part 24 and the first right branch conductor part 23 are collectively called an outer peripheral part of the third electric conductor 16.

The second conductor 14 which is drawn at the center in FIG. 3 has a second buried conductor part 31 as a buried conductor part, a second connecting conductor part 32, a third connecting conductor part 33, a first projecting part 34 as a branch conductor part, a second projecting part 35 as a branch conductor part, a third projecting part 36 as a branch conductor part and a fourth projecting part 37 as a branch conductor part.

The second buried conductor part 31 has a long rectangular shape. The second connecting conductor part 32 is provided to extend from one end in a long side direction of the second buried conductor part 31. The third connecting conductor part 33 is provided to extend at the other end in the long side direction of the second buried conductor part 31. The total length of the second connecting conductor part 32, the second buried conductor part 31 and the third connecting conductor part 33 is shorter than the entire length in the long side direction of the coil main body 1 as shown in FIGS. 2B and 2C.

The first projecting part 34 and the second projecting part 35 are provided to extend from the second connecting conductor part 32. The first projecting part 34 and the second projecting part 35 are provided to extend from the second connecting conductor part 32 in the opposite directions from each other. The first projecting part 34 has the shape with one end side of a substantially rectangle curved. The curved portion of the first projecting part 34 extends from the second connecting conductor part 32. The linear portion of the first projecting part 34 is substantially parallel with the long side direction of the second buried conductor part 31. The second projecting part 35 has the shape of a substantially rectangle with one end side in the long side direction curved. The curved direction of the second projecting part 35 is opposite from the curved direction of the first projecting part 34. The curved portion of the second projecting part 35 extends from the second connecting conductor part 32. The linear portion of the second projecting part 35 is substantially parallel with the long side direction of the second buried conductor part 31.

The third projecting part 36 and the fourth projecting part 37 are provided to extend from the third connecting conductor part 33. The third projecting part 36 and the fourth projecting part 37 are provided to extend from the third connecting conductor part 33 in the opposite directions from each other. The third projecting part 36 has the shape of a substantially rectangle with one end side curved. A curved portion of the third projecting part 36 extends from the third connecting conductor part 33. A linear portion of the third projecting part 36 is substantially parallel with the long side direction of the second buried conductor part 31. The fourth projecting part 37 has the shape of a substantially rectangle with one end side in the long side direction curved. A curving direction of the fourth projecting part 37 is opposite from a curving direction of the third projecting part 36. A curved portion of the fourth projecting part 37 extends form the third connecting conductor part 33. A linear portion of the fourth projecting part 37 is substantially parallel with the long side direction of the second buried conductor part 31.

The second buried conductor part 31 has the same width as the first embedded conductor part 21. The first projecting part 34, the second projecting part 35, the third projecting part 36 and the fourth projecting part 37 have the same width as the first left branch conductor part 22 and the first right branch conductor part 23. A tip end of the first projecting part 34 and a tip end of the third projecting part 36 face each other. A tip end of the second projecting part 35 and a tip end of the fourth projecting part 37 face each other. As a result, the second buried conductor part 31, the first projecting part 34 and the second projecting part 35 are aligned substantially in parallel, and the first projecting part 34 and the second projecting part 35 are provided to extend along both sides of the second buried conductor part 31. The second buried conductor part 31, the third projecting part 36 and the fourth projecting part 37 are aligned substantially in parallel, and the third projecting part 36 and the fourth projecting part 37 are provided to extend along both sides of the second buried conductor part 31. Hereinafter, the first projecting part 34, the second connecting conductor part 32, the third projecting part 36, the fourth projecting part 37, the third connecting conductor part 33 and the third projecting part 36 are collectively called a peripheral part of the second electric conductor 14.

The first electric conductor 12 which is drawn at the lowest position in FIG. 3 has a third buried conductor part 41 as a buried conductor part, a second left branch conductor part 42 as a branch conductor part, a second right branch conductor part 43 as a branch conductor part, and a fourth connecting conductor part 44.

The third buried conductor part 41 has a long rectangular shape. The fourth connecting conductor part 44 is provided to extend from one end in the long side direction of the third buried conductor part 41. The total length of the third buried conductor part 41 and the fourth connecting conductor part 44 is shorter than the entire length in the long side direction of the coil main body 1 as shown in FIGS. 2A and 2B. The second right branch conductor part 43 and the second left branch conductor part 42 are provided to extend from the fourth connecting conductor part 44. The second right branch conductor part 43 and the second left branch conductor part 42 extend from the fourth connecting conductor part 44 in the opposite directions from each other.

The second right branch conductor part 43 has a shape of a substantially rectangle with one end side curved. The curved portion of the second right branch conductor part 43 extends from the fourth connecting conductor part 44. The linear portion of the second right branch conductor part 43 is substantially parallel with the long side direction of the third buried conductor part 41. The second left branch conductor part 42 has the shape of a substantially rectangle with one end side in the long side direction curved. The curving direction of the second left branch conductor part 42 is opposite from the curving direction of the second right branch conductor part 43. The curved portion of the second left branch conductor part 42 is provided to extend from the fourth connecting conductor part 44. The linear portion of the second left branch conductor part 42 is substantially parallel with the long side direction of the third buried conductor part 41.

The second right branch conductor part 43 and the second left branch conductor part 42 have the same width as the first left branch conductor part 22 and the first right branch conductor part 23. The third buried conductor part 41 has the same width as the first buried conductor part 21. As a result, the third buried conductor part 41, the second left branch conductor part 42 and the second right branch conductor part 43 are aligned substantially in parallel, and the second left branch conductor part 42 and the second right branch conductor part 43 are provided to extend along both sides of the third buried conductor part 41. Accordingly, the first electric conductor 12 is formed into the shape similar to the anchor of a ship, which is made by bonding "J" of the alphabet and the "J" which is reversed in the lateral direction, back to back. The entire width of the first electric conductor 12 equals the width in the short side direction of the coil main body 1. Hereinafter, the second left branch conductor part 42, the fourth connecting conductor part 44 and the second right branch conductor part 43 are collectively called an outer peripheral part of the first electric conductor 12.

The first electric conductor 12, the second electric conductor 14 and the third electric conductor 16 are buried in the coil main body 1 as shown in FIGS. 2A to 2E. The third electric conductor 16 has the first buried conductor part 21 connected to the first external electrode 2 at one end side of the coil main body 1. The first electric conductor 12 has the third buried conductor part 41 connected to the second external electrode 3 at the other end side of the coil main body 1. The second electric conductor 14 is buried between the first electric conductor 12 and the third electric conductor 16 so that the second connecting conductor part 32 overlays the fourth connecting conductor part 44 of the first conductor 12, and the third connecting conductor part 33 overlays the first connecting conductor part 24 of the third electric conductor 16.

As shown in FIG. 2C, the first left branch conductor part 22 of the third electric conductor 16 is connected to the first projecting part 34 of the second electric conductor 14. The third projecting part 36 of the second electric conductor 14 is connected to the second left branch conductor part 42 of the first electric conductor 12. As a result, the first buried conductor part 21, the first connecting conductor part 24, the first left branch conductor part 22, the first projecting part 34, the second connecting conductor part 32, the second buried conductor part 31, the third connecting conductor part 33, the third projecting part 36, the second left branch conductor part 42, the fourth connecting conductor part 44 and the third buried conductor part 41 form a first coil.

The first right branch conductor part 23 of the third electric conductor 16 is connected to the second projecting part 35 of the second electric conductor 14. The fourth projecting part 37 of the second electric conductor 14 is connected to the second right branch conductor part 43 of the first electric conductor 12. As a result, the first buried conductor part 21, the first connecting conductor part 24, the first right branch conductor part 23, the second projecting part 35, the second connecting conductor part 32, the second buried conductor part 31, the third connecting conductor part 33, the fourth projecting part 37, the second right branch conductor part 43, the fourth connecting conductor part 44 and the third buried conductor part 41 form a second coil.

Both ends of the first coil and the second coil as above are connected to the first external electrode 2 and the second external electrode 3. For example, an electric current, which flows into the surface-mount coil from the first external electrode 2, flows through the first buried conductor part 21. The electric current flowing through the first buried conductor part 21 branches into an electric current flowing into the first left branch conductor part 22 and an electric current flowing into the first right branch conductor part 23. The electric current flowing into the first left branch conductor part 22 and the electric current flowing into the first right branch conductor part 23 meet each other in the second connecting conductor part 32 of the second electric conductor 14, and flow into the second buried conductor part 31. The electric current flowing into the second buried conductor part 31 branches into an electric current flowing into the third projecting part 36 and an electric current flowing into the fourth projecting part 37 in the third connecting conductor part 33. The electric current flowing into the third projecting part 36 and the electric current flowing into the fourth projecting part 37 meet each other in the fourth connecting conductor part 44, and flow into the third buried conductor part 41. The electric current flowing into the third buried conductor part 41 flows outside the surface-mount coil from the second external electrode 3. The electric current in the opposite direction from the above described current can be passed into the surface-mount coil toward the first external electrode 2 from the second external electrode 3.

Returning to FIGS. 2A to 2E, the coil main body 1 has a first inter-wiring nonmagnetic substance 13 as a nonmagnetic part between conductors, and a second inter-wiring nonmagnetic substance 15 as a nonmagnetic part between conductors.

The first inter-wiring magnetic substance 13 is placed between the first electric conductor 12 or the nonmagnetic gap substance 9, and the second electric conductor 14. The first inter-wiring nonmagnetic substance 13 is provided between the third buried conductor part 41 and the second buried conductor part 31, between the fourth connecting conductor part 44 and the second connecting conductor part 32, between the first projecting part 34 and the second left branch conductor part 42, between the third projecting part 36 and the nonmagnetic gap substance 9, between the third connecting conductor part 33 and the third buried conductor part 41, and between the fourth projecting part 37 and the nonmagnetic gap substance 9. Namely, the first inter-wiring nonmagnetic substance 13 is provided by being overlaid on the outer peripheral portion and the central conductor portion of the coil between the first electric conductor 12 or the nonmagnetic gap substance 9 and the second electric conductor 14.

The second inter-wiring nonmagnetic substance 15 is placed between the second electric conductor 14 and the third electric conductor 16 or a covering magnetic substance 17 that will be described later. The second inter-wiring nonmagnetic substance 15 is provided between the second buried conductor part 31 and the first buried conductor part 21, between the second connecting conductor part 32 and the first buried conductor part 21, between the first projecting part 34 and the covering magnetic substance 17, between the third projecting part 36 and the first left branch conductor part 22, between the third connecting conductor part 33 and the first connecting conductor part 24, and between the fourth projecting part 37 and the first right branch conductor part 23. Namely, the second inter-wiring nonmagnetic substance 15 is provided to overlay on the outer peripheral portion and the center conductor portion of the coil between the second electric conductor 14 and the third electric conductor 16 or the covering magnetic substance 17 which will be described later.

The coil main body 1 has a first intra-spiral magnetic substance 8, a second intra-spiral magnetic substance 7 and the covering magnetic substance 17. The same material as the main body substrate 11 is used for the first intra-spiral magnetic substance 8, the second intra-spiral magnetic substance 7 and the covering magnetic substance 17. A core made of a magnetic material is formed by the main body substrate 11, the first intra-spiral magnetic substance 8, the second intra-spiral magnetic substance 7 and the covering magnetic substance 17.

The first intra-spiral magnetic substance 8 is placed inside one coil (first coil) of the two coils formed by the first electric conductor 12, the second electric conductor 14 and the third electric conductor 16.

The second intra-spiral magnetic substance 7 is placed inside the other coil (second coil) of the two coils formed by the first electric conductor 12, the second electric conductor 14 and the third electric conductor 16.

The covering magnetic substance 17 is formed into a rectangular parallelepiped shape longer than wide of the same size as the main body substrate 11 on the third electric conductor 16.

As shown in FIGS. 2A, 2B and 2C, a first nonmagnetic substance 18 is placed at a periphery of one end portion in the long side direction of the coil main body 1. A second nonmagnetic substance 19 is placed in a periphery of the other end portion in the long side direction of the coil main body 1. The first nonmagnetic substance 18 is provided between a perimeter portion of the coil and the first external electrode 2, and the second nonmagnetic substance 19 is provided between the perimeter portion of the coil and the second external electrode 3. The first nonmagnetic substance 18 and the second nonmagnetic substance 19 are formed of a nonmagnetic ceramics member. The first nonmagnetic substance 18 and the second nonmagnetic substance 19 are formed over the entire width in the short side direction of the coil main body 1 as shown in FIGS. 2A and 2D.

As a result, the first connecting conductor part 24 of the third electric conductor 16, the third connecting conductor part 33 and the second connecting conductor part 32 of the second electric conductor 14, and the fourth connecting conductor part 44 of the first electric conductor 12 are exposed on the surface of the core, and the exposed part is covered with the first nonmagnetic substance 18 and the second nonmagnetic substance 19.

As shown in FIGS. 2A and 2D, both end surfaces in the short side direction of the coil main body 1 (namely, side surfaces in the long side direction) are covered with a coating layer 20. The coating layer 20 is formed of a nonmagnetic and nonconductive material such as glass.

As a result, the first left branch conductor part 22 and the first right branch conductor part 23 of the third electric conductor 16, the first projecting part 34, the second projecting part 35, the third projecting part 36 and the fourth projecting part 37 of the second electric conductor 14, and the second left branch conductor part 42 and the second right branch conductor part 43 of the first electric conductor 12 are exposed on the surface of the core, and the exposed part is covered with the coating layer 20.

As for the outer peripheral part of the third electric conductor 16, the outer peripheral part of the second electric conductor 14 and the outer peripheral part of the first electric conductor 12, the entire exposed portions of them are covered with the first nonmagnetic substance 18, the second nonmagnetic substance 19 and the coating layer 20.

Figure 7A:
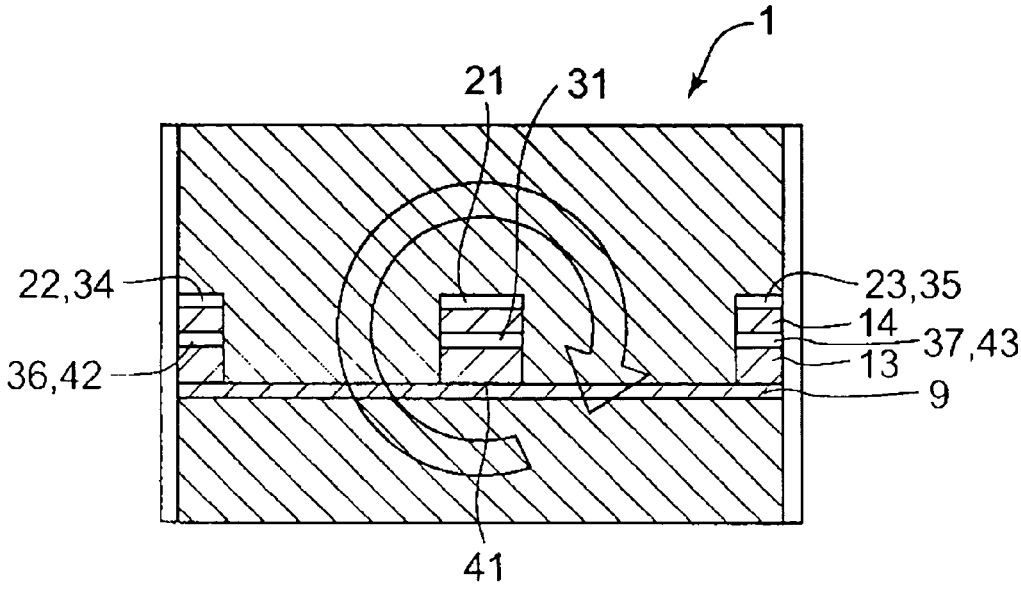
FIGS. 7A and 7B are views showing schematic sectional views of the surface-mount coil according to the embodiment and the surface-mount coil according to the comparative example.

By being constructed as above, the first buried conductor part 21, the second buried conductor part 31 and the third buried conductor part 41 are disposed in the center of the coil main body 1, and the first left branch conductor part 22, the first right branch conductor part 23, the first projecting part 34, the second projecting part 35, the third projecting part 36, the fourth projecting part 37, the second left branch conductor part 42 and the second right branch conductor part 43 are disposed to be symmetric with respect to a line seen from the center axis of the first buried conductor part 21, the second buried conductor part 31 and the third buried conductor part 41 (see FIG. 7A).

Next, electrical characteristics of the surface-mount coil according to the embodiment having the above construction will be explained.

Figure 4:
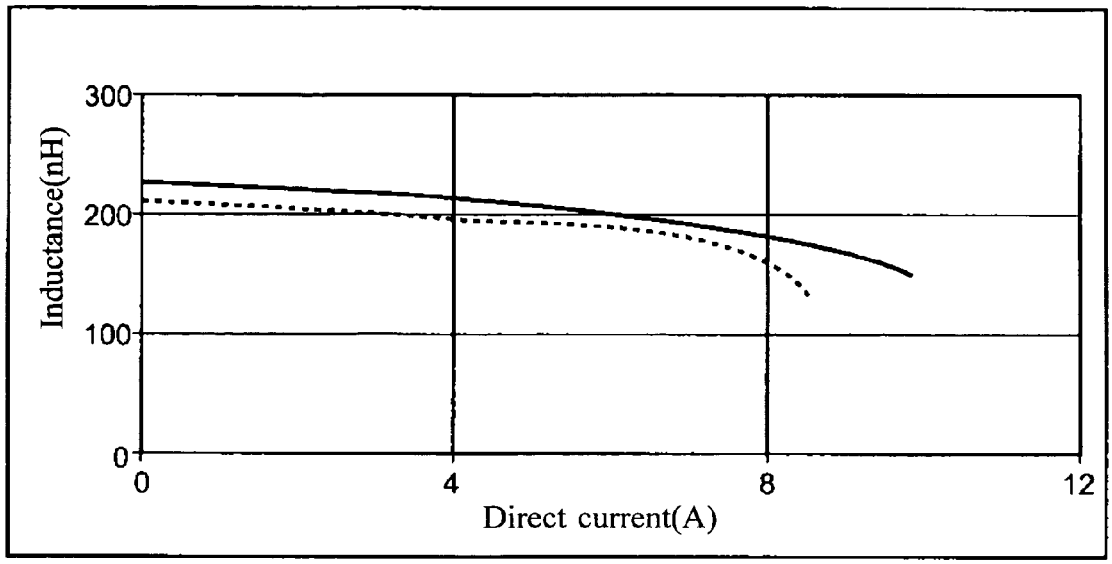
FIG. 4 is a diagram showing direct-current saturation characteristics of the surface-mount coil shown in FIGS. 1A and 1B and the surface-mount coil according to a comparative example shown in FIG. 5.

FIG. 4 is a diagram showing one example of a direct-current saturation characteristic of the surface-mount coil shown in FIG. 1. The horizontal axis represents a direct current which flows in the surface-mount coil. In the drawing, the value of the direct current becomes larger toward the right side. The vertical axis represents the inductance of the surface-mount coil. In the drawing, the value of an inductance becomes larger toward the top. The characteristic curve shown by the solid line represents the direct-current saturation characteristic of the surface-mount coil shown in FIG. 1. The characteristic curve shown by the broken line represents a direct-current saturation characteristic of the surface-mount coil of a comparative example.

Figure 5:
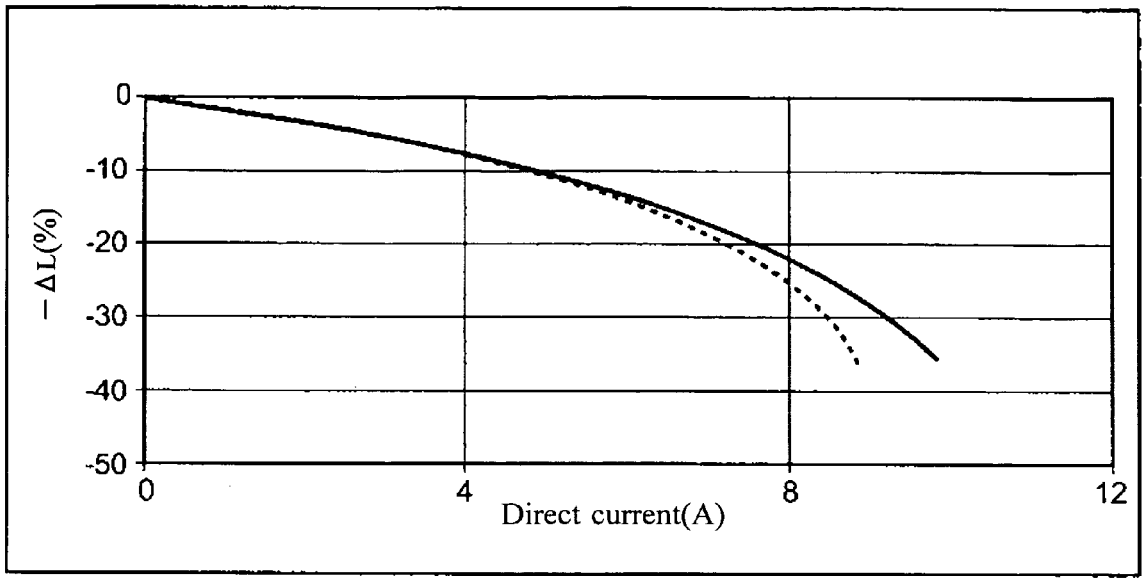
FIG. 5 is a diagram showing differentiation characteristics of the direct-current saturation characteristics of the surface-mount coil shown in FIGS. 1 and 2 and the surface-mount coil according to the comparative example shown in FIG. 5.

FIG. 5 is a diagram showing an example of a decreasing rate of the inductance of the surface-mount coil shown in FIG. 1 with respect to a direct current. The horizontal axis represents the direct-current flowing in the surface-mount coil. The value of the direct current becomes larger toward the right side in the drawing. The vertical axis is the decreasing rate of the inductance of the surface-mount coil. The decreasing rate of the inductance becomes larger toward the bottom in the drawing. The characteristic curve shown by the solid line shows the decreasing rate of the inductance of the surface-mount coil shown in FIG. 1 with respect to the direct current. The characteristic curve shown by the broken line shows the decreasing rate of the inductance of the surface-mount coil of the comparative example with respect to the direct-current.

Figure 6A:
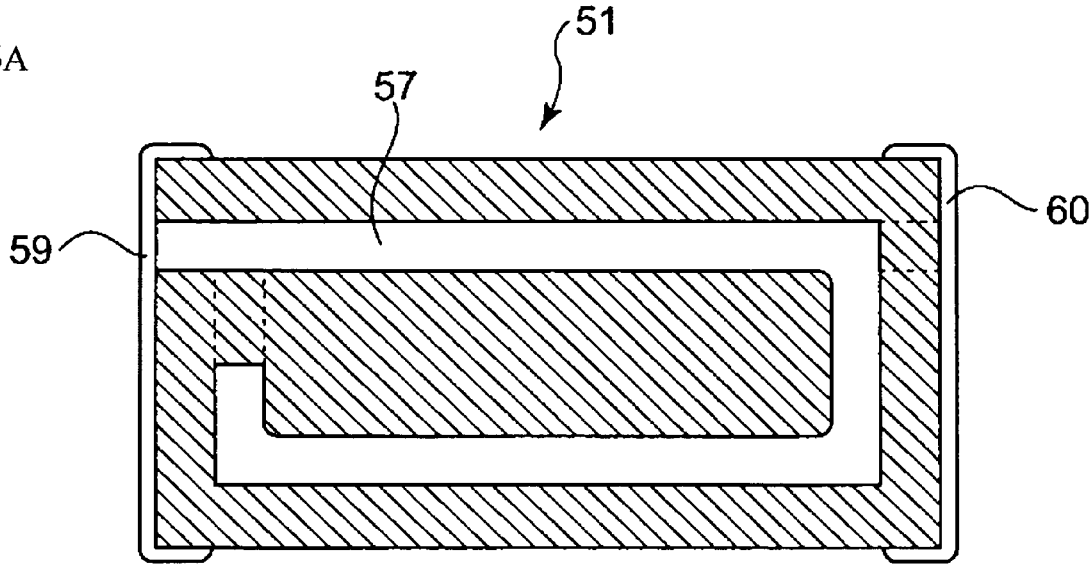
FIGS. 6A and 6B are sectional views showing an internal structure of the surface-mount coil according to the comparative example.
Figure 6B:
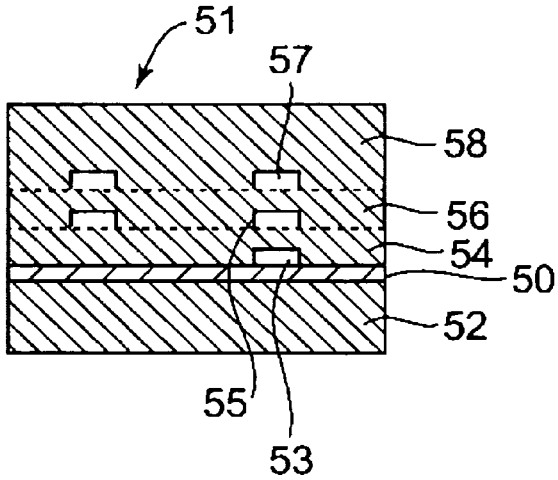

FIG. 6 is a sectional view showing the internal structure of the surface-mount coil according to the comparative example. FIG. 6A is a cross-sectional view of the surface-mount coil according to the comparative example. FIG. 6B is the vertical sectional view in the central part in the long side direction of the surface-mount coil according to the comparative example.

In a coil main body 51 of the surface-mount coil according to this comparative example, a nonmagnetic gap substance 50 is layered on a main body substrate 52 formed of a magnetic material such as ferrite. The coil main body has the structure in which a first electric conductor 53, a first magnetic substance 54, a second electric conductor 55, a second magnetic substance 56, a third electric conductor 57 and a covering magnetic substance 58 are layered on the nonmagnetic gap substance 50. The first electric conductor 53, the second electric conductor 55 and the third electric conductor 57 form one coil. Both ends of the coil are connected to a first external electrode 59 and a second external electrode 60.

The coil is formed to have the same line width as the first left branch conductor part 22 and the like of the surface-mount coil according to the embodiment of the present invention in order to ensure the size of the core around the coil. This is a half of the line width of the first buried conductor part 21 and the like of the surface-mount coil according to the embodiment of the present invention. Therefore, the direct-current resistance value of the surface-mount coil according to the comparative example is about twice as large as the direct-current resistance value of the surface-mount coil according to this embodiment. In order to lower the direct-current resistance value, the thickness of the coil is increased.

As shown in FIGS. 4 and 5, in the surface-mount coil according to the embodiment, the inductance value at the time of the direct current of 0 ampere is larger by about 10 to 15% as compared with the surface-mount coil according to the comparative example. The surface-mount coil according to the embodiment always has a larger inductance value than the inductance value of the surface-mount coil according to the comparative example when the direct current is passed.

Further, the surface-mount coil according to the embodiment suppresses the decreasing rate of the inductance value even when a large direct current (for example, eight amperes or more) with which the inductance value would significantly decrease in the surface-mount coil according to the comparative example.

As described above, the surface-mount coil according to the embodiment has a larger inductance value as compared with the surface-mount coil according to the comparative example, and has the excellent direct-current saturation characteristic.

Figure 7B:
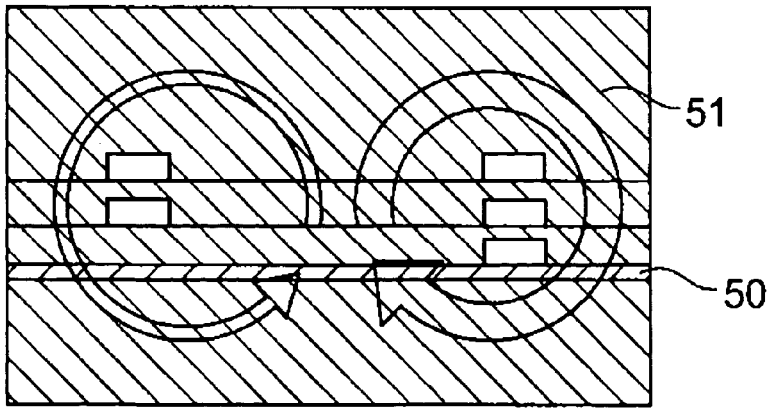

Incidentally, the following are conceivable as the reasons of the surface-mount coil according to the embodiment exhibiting the high inductance value and the excellent direct-current saturation characteristic. FIG. 7A is a schematic sectional view of the surface-mount coil according to the embodiment of the present invention. FIG. 7B is a schematic sectional view of the surface-mount coil according to the comparative example.

First, in the surface-mount coil according to the present embodiment, the third buried conductor part 41, the second buried conductor part 31 and the first buried conductor part 21 are buried in the central part of the core. The second left branch conductor part 42 and the second right branch conductor part 43, which become the outer peripheral part, are placed to sandwich the third buried conductor part 41 therebetween. The first projecting part 34 and the second projecting part 35, which become the outer peripheral part, are placed to sandwich the second buried conductor part 31 therebetween, the third projecting part 36 and the fourth projecting part 37, which become the outer peripheral part, are placed to sandwich the second buried conductor part 31 therebetween, the first left branch conductor part 22 and the first right branch conductor part 23, which become the peripheral part, are placed to sandwich the first buried conductor part 21 therebetween.

Therefore, the surface-mount coil according to the present embodiment can ensure large thickness of the core over their entire periphery, around the three buried conductor parts that are the third buried conductor part 41, the second buried conductor part 31 and the first buried conductor part 21 (namely, the sectional area of the magnetic path can be made large), as shown in FIG. 7A. Accordingly, comparing FIGS. 7A and 7B, in the case of the same size, the thickness of the core ensured around the three buried conductor parts of the surface-mount coil of the present embodiment is larger than the thickness of the core ensured around the conductors of the coil in the surface-mount coil according to the comparative example.

Since the thick core can be ensured around the three buried conductor parts, in the surface-mount coil according to the present embodiment, the magnetic flux formed around the three buried conductor parts by the current flowing in the three buried conductor parts is difficult to saturate in the core. As a result, it is conceivable that the surface-mount coil according to the present embodiment exhibits the excellent direct-current saturation characteristic that the inductance value is difficult to decrease even if a larger direct current is superimposed as compared with the surface-mount coil according to the comparative example. Namely, the same direct-current saturation characteristic can be obtained with the small size. Especially in the surface-mount coil according to the present embodiment, it is possible to effectively suppress the concentration of magnetism by making the thickness of the core uniform around the three buried conductor parts.

Second, in the surface-mount coil according to the present embodiment, the outer peripheral part of the third electric conductor 16, the outer peripheral part of the second electric conductor 14 and the outer peripheral part of the first electric conductor 12 are exposed on the surface of the core. As a result that the outer peripheral parts are exposed on the surface of the core, the magnetic lines of force by the current flowing in the outer peripheral parts do not close in the core. It is conceivable that for this reason, the magnetic flux by the electric current flowing in the outer peripheral parts is difficult to become high in the core.

The magnetic lines of force of the outer peripheral parts do not close in the core, and therefore, in the surface-mount coil according to the present embodiment, only the magnetic lines of force by the electric current flowing in the three buried conductor parts close in the core as shown in FIG. 7A. It is conceivable that for this reason, in the surface-mount coil according to the present embodiment, the electric current which can be passed into the three buried conductor parts before the core is saturated increases and even if a larger direct current is superimposed, a high inductance value can be maintained.

On the other hand, in the surface-mount coil according to the comparative example, the magnetic lines of force by the electric current flowing through the right side conductor of the coil and the magnetic lines of force by the electric current flowing through the left side conductor of the coil close in the core. In the surface-mount coil according to the comparative example, the magnetic flux density between the right side conductor and the left side conductor of the coil is higher than the densities of the magnetic fluxes which are respectively formed by them, and it is about 1.5 to 2 times as high as the magnetic flux density formed by the right side conductor of the coil.

In the surface-mount coil according to the comparative example, the number of the conductors at the left side and the number of the conductors at the right side differ. The number of conductors at the left side is always smaller than that of conductors at the right side by one. Therefore, in the surface-mount coil according to the comparative example, the magnetic fluxes in the core are formed to be unbalanced at the right side and the left side of the core. The distribution of magnetic lines of force and the distribution of magnetic flux density in the core when the core is saturated are difficult to estimate.

In the surface-mount coil according to the present embodiment, the magnetic flux structure in the core by the electric current flowing in the outer peripheral parts is simple, and therefore, the actual measurement value close to the inductance value which is calculated based on the size of the core at the inner side of the outer peripheral part and the total electric current flowing in the three buried conductor parts can be obtained.

Therefore, in the surface-mount coil according to the present embodiment, in manufacturing a surface-mount coil having a predetermined inductance value, it can be expected that the number of correcting operations for matching the inductance value with the desired value decreases. Besides, design of the surface-mount coil is facilitated.

Third, in the surface-mount coil according to the present embodiment, it is expected that the flux density in the core by the electric current flowing in the outer peripheral parts is difficult to be high as described above. In addition, the three buried conductor parts are formed with the maximum length substantially parallel with the long side direction of the core. Namely, in the surface-mount coil according to this embodiment, the length of the conductor parts covered with the core is long, and the core for enhancing the self-inductance action by the electric current flowing in the conductor parts is placed to be thick around the conductor parts. It is conceivable that as a result of this, in the surface-mount coil according to this embodiment, the self-inductance action in the conductor parts is high, and thus the inductance value of the surface-mount coil becomes large.

The surface-mount coil according to this embodiment has the following effect in addition to the effect of improvement in the inductance value and the direct-current saturation characteristic as described above.

First, in the surface-mount coil according to the present embodiment, the outer peripheral part of the third electric conductor 16, the outer peripheral part of the second electric conductor 14 and the outer peripheral part of the first electric conductor 12 are covered with the coating layer 20, the first nonmagnetic substance 18 and the second nonmagnetic substance 19. The coating layer 20, the first nonmagnetic substance 18 and the second nonmagnetic substance 19 are formed of a nonconductive and nonmagnetic material.

Accordingly, in the surface-mount coil according to the present embodiment, the magnetic lines of force by the electric current flowing in these outer peripheral parts are not closed in the magnetic material, solder is prevented from attaching to the outer peripheral parts exposed on the surface of the core, and the other conductive materials are prevented from contacting the outer peripheral parts exposed on the surface of the core.

Second, in the surface-mount coil according to the present embodiment, the third buried conductor part 41 is formed to have the width which is the width obtained by adding the width of the second left branch conductor part 42 and the width of the second right branch conductor part 43. The second buried conductor part 31 is formed to have the width which is the width obtained by adding the width of the first projecting part 34 and the width of the second projecting part 35. The first buried conductor part 21 is formed to have the width obtained by adding the width of the first left branch conductor part 22 and the width of the first right branch conductor part 23. Accordingly, in the surface-mount coil according to the present embodiment, the value of the direct-current resistance of the element can be lowered as compared with the surface-mount coil according to the comparative example.

In addition, in the surface-mount coil according to the present embodiment, even if these three buried conductor parts are formed to be wide as above, the thick core can be secured around these three buried conductor parts, and therefore, the influence on the direct-current saturation characteristic is small. Accordingly, the direct-current resistance value can be lowered while a favorable direct-current saturation characteristic is ensured.

In the surface-mount coil according to the present embodiment, three buried conductor parts are formed to be wide, and therefore, even if the thickness of each of the buried conductor parts formed by printing is made to be 120 micrometers or less and the thickness of the buried conductor part is made thin, the direct-current resistance value equivalent to the prior art is obtained. In that case, in the surface-mount coil according to the present embodiment, the thickness of the buried conductor part is thin, and the thickness of the surface-mount coil becomes thin correspondingly. It is possible to increase the number of turns of coil while suppressing the thickness of the surface-mount coil. In this case, the thickness of the buried conductor part is thin, and therefore, on an occasion of alternately layering the respective electric conductors and the magnetic substance layers by printing, asperities on the print surface due to thickness of the electric conductor part previously printed decreases. And in, for example, the third electric conductor 16 or the like which is to be newly printed, occurrence of breaking of wire inside the core of the conductor can be effectively suppressed.

Third, in the surface-mount coil according to the present embodiment, the nonmagnetic gap substance 9 made of a nonmagnetic material is included. This nonmagnetic gap substance 9 contacts the first electric conductor 12. The nonmagnetic gap substance 9 is formed to be in a size over the entire surface of the coil main body 1 to be along the arrangement direction of the third buried conductor part 41, the second left branch conductor part 42 and the second right branch conductor part 43 of the first electric conductor 12 and to divide the core into two parts (the main body substrate 11 and the other parts 7, 8 and 17). Therefore, the nonmagnetic layer is formed so that the nonmagnetic gap substance 9 intersects the magnetic flux generated by the coil main body 1. This nonmagnetic layer is formed in the orthogonal direction to the direction in which the magnetic flux turns so as to partition the magnetic flux formed in the core, in other words, to cut off the magnetic path formed in the core, and therefore, the core can be restrained from being in the magnetic saturation state.

The nonmagnetic gap substance 9 can restrains the core from being brought into the magnetic saturation state even if the nonmagnetic gap substance 9 is placed between the first electric conductor 12 and the second electric conductor 14 to contact with at least one of them, or the nonmagnetic gap substance 9 is placed between the second electric conductor 14 and the third electric conductor 16 to contact with at least one of them, or the nonmagnetic gap substance 9 is placed on the third electric conductor 16 to contact the third electric conductor 16.

Fourth, in the surface-mount coil according to the present embodiment, the internal conductor forms a first spiral and a second spiral in the coil main body 1. Between the conductors overlaying each other in the first spiral, the first inter-wiring nonmagnetic substance 13 and the second inter-wiring nonmagnetic substance 15 which are made of the nonmagnetic material are placed. Between the conductors parallel in the second spiral, the first inter-wiring nonmagnetic substance 13 and the second inter-wiring nonmagnetic substance 15 which are made of the nonmagnetic material are placed. Therefore, though the internal conductor forms the first spiral and the second spiral, occurrence of the closed magnetic flux to the core (so-called, short pass of the magnetic flux) can be prevented between the conductors overlaying each other in the spirals.

If the first inter-wiring nonmagnetic substance 13 and the second inter-wiring nonmagnetic substance 15 are formed between at least the conductors overlaying each other, the effect of restraining occurrence of short pass of the magnetic flux can be expected. Namely, by forming the nonmagnetic part between the conductors is formed to cover the entire internal conductors instead of the first inter-wiring nonmagnetic substance 13 and the second inter-wiring nonmagnetic substance 15, for example, short pass of the magnetic flux can be prevented.

Next, a manufacturing method suitable for manufacture of the coil main body 1 having the above characteristics will be explained. FIGS. 8 to 11 explain the manufacturing method of the coil main body 1 according to an embodiment of the present invention.

Figure 8A:
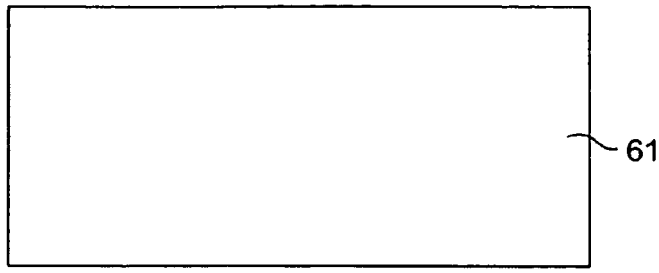
FIGS. 8A to 8D are manufacturing process diagrams showing a method for manufacturing a coil main body according to the embodiment of the present invention (1)

First, as shown in FIG. 8A, a rectangular green sheet 61 made of a magnetic material in the size from which a plurality of coil main bodies 1 can be made is prepared. The green sheet 61 shown in FIG. 8A has the size from which four of the coil main bodies 1 shown in FIG. 1 can be formed.

Figure 8B:
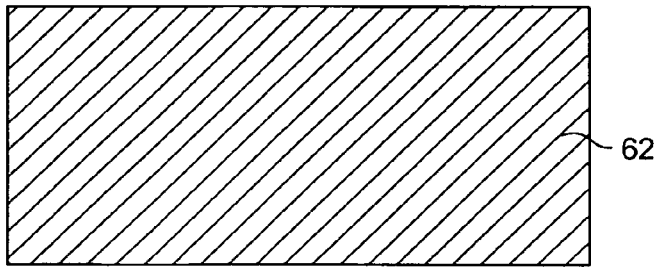

Next, as shown in FIG. 8B, the nonmagnetic layer is formed on this green sheet 61. This nonmagnetic layer 62 is formed on the entire surface of the green sheet 61. The nonmagnetic layer 62 is for forming the nonmagnetic gap substance 9.

Figure 8C:
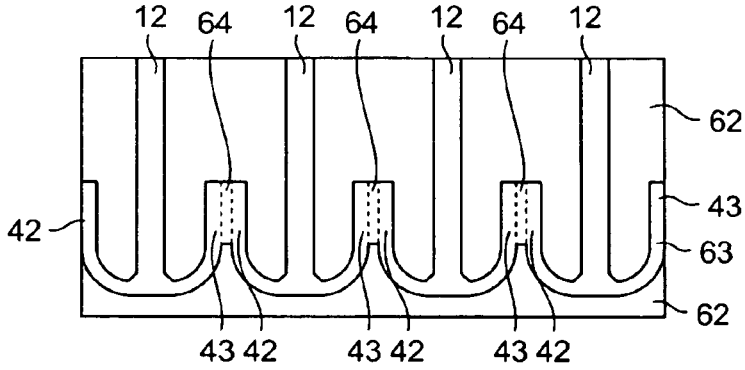

Next, as shown in FIG. 8C, a first conductor pattern 63 is printed on the nonmagnetic layer 62. This first conductor pattern 63 is for forming the first electric conductor 12. Therefore, the first conductor pattern 63 becomes a pattern in which four of the anchor-shaped first electric conductors 12 are arranged laterally in a line. The first conductor pattern 63 especially is the pattern in which the second right branch conductor parts 43 of the first electric conductors 12 at the left side are connected to the second left branch conductor parts 42 of the first electric conductors 12 at the right side by cut margin parts 64.

Figure 8D:
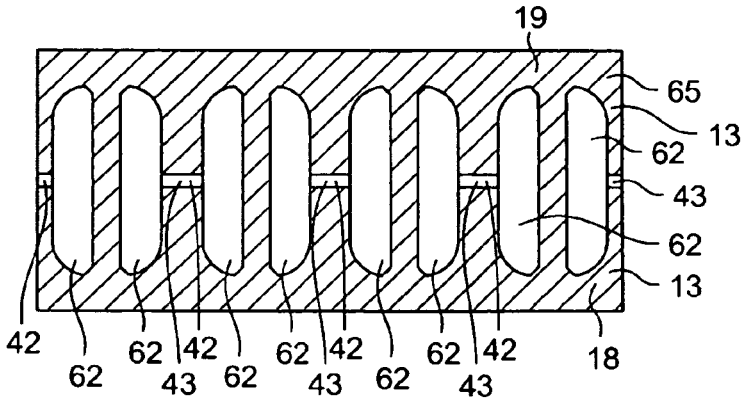

Next, as shown in FIG. 8D, a first nonmagnetic substance layer 65 is printed on the first conductor pattern 63. The first nonmagnetic substance layer 65 is printed on the remaining parts, except for both sides of the first electric conductors 12, and the part from the tip end portions of the second left branch conductor parts 42 to the tip end portions of the second right branch conductor parts 43. The first nonmagnetic substance layer 65 becomes a part of the first inter-wiring nonmagnetic substance 13, a part of the first nonmagnetic substance 18 and a part of the second nonmagnetic substance 19.

Figure 9A:
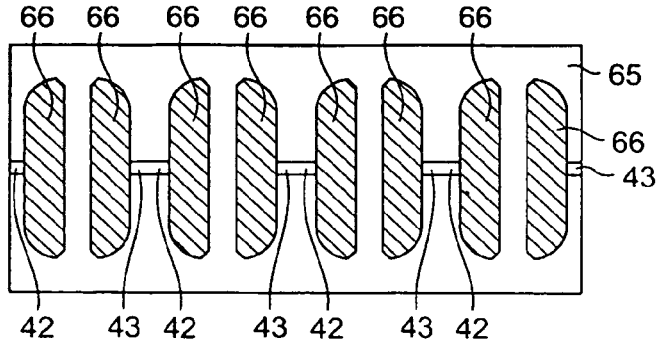
FIGS. 9A to 9D are manufacturing process diagrams showing the method for manufacturing the coil main body according to the embodiment of the present invention (2)

Next, as shown in FIG. 9A, a first magnetic substance layer 66 is printed on the parts at both sides of the first electric conductors 12, on which the first nonmagnetic substance layer 65 is not printed. The first magnetic substance layer 66 becomes a part of the magnetic substance 8 in the first spiral and a part of the magnetic substance 7 in the second spiral.

As a result, in the state in which the first magnetic substance layer 66 and the first nonmagnetic substance layer 65 are printed on the green sheet 61 and the first conductor pattern 63, the first conductor pattern 63 is exposed on the region corresponding to the end portions of the second right branch conductor parts 43 of the first electric conductors 12, the region corresponding to the end portions of the second left branch conductor parts 42 and the cut margin parts 64 which connect these end portions.

Figure 9B:
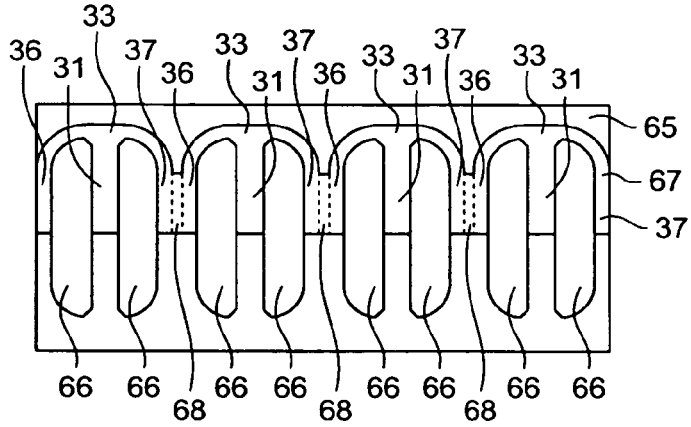

Next, as shown in FIG. 9B, a second conductor pattern 67 is printed. The second conductor pattern 67 is printed on the first nonmagnetic substance layer 65 and the exposed parts of the first conductor pattern 63 by being overlaid on them. The second conductor pattern 67 is formed around the first magnetic substance layer 66. The second conductor pattern 67 forms a part of the second electric conductor 14. Therefore, the second conductor pattern 67 becomes the pattern in which four of the second electric conductors 14 are laterally arranged in a line and are halved. The second conductor pattern 67 is the pattern in which the fourth projecting parts 37 of the second electric conductors 14 are connected to the third projecting parts 36 of the second electric conductors 14 by cut margin parts 68.

Figure 9C:
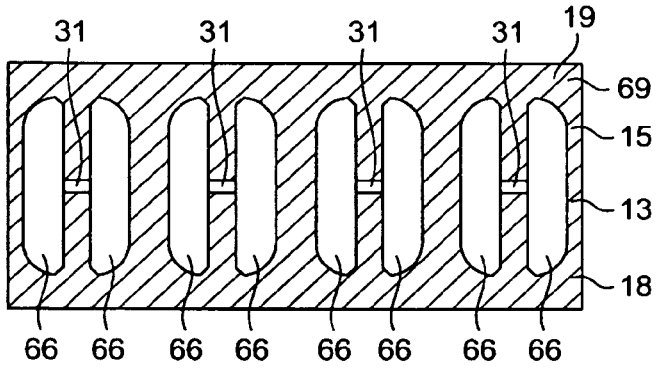

Next, a second nonmagnetic substance layer 69 is printed as shown in FIG. 9C. The second nonmagnetic substance layer 69 is printed on the remaining part, excepting the top of the first magnetic substance layer 66 and the tip end portions of the second buried conductor parts 31 of the second conductor pattern 67. An upper half of the second nonmagnetic substance layer 69 in FIG. 9C becomes a part of the second inter-wiring nonmagnetic substance 15 and a part of the second nonmagnetic substance 19, and a lower half thereof in FIG. 9C becomes a part of the first inter-wiring nonmagnetic substance 13 and a part of the first nonmagnetic substance 18.

Figure 9D:
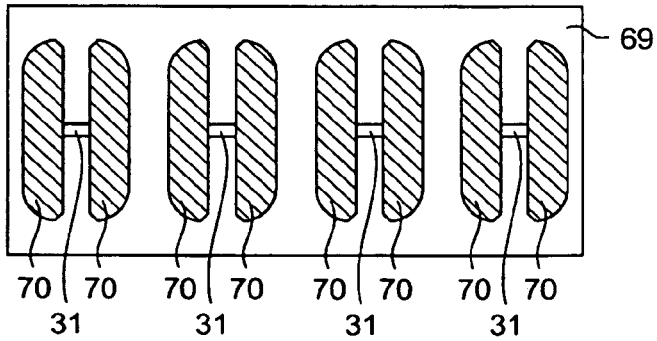

Next, as shown in FIG. 9D, a second magnetic substance layer 70 is printed on the first magnetic substance layer 66. The second magnetic substance layer 70 becomes a part of the magnetic substance 8 in the first spiral and the magnetic substance 7 in the second spiral.

Thereby, in the state in which the second magnetic substance layer 70 and the second non-magnetic substance layer 69 are printed, the second conductor pattern 67 is exposed on the tip end portion of the second buried conductor parts 31.

Figure 10A:
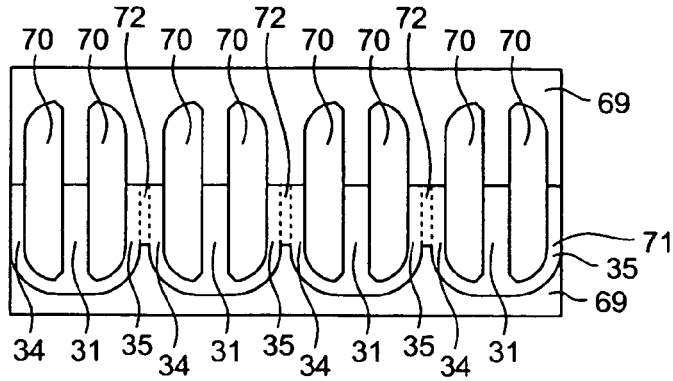
FIGS. 10A to 10D are manufacturing process diagrams showing the method for manufacturing the coil main body according to the embodiment of the present invention (3)

Next, as shown in FIG. 10A, a third conductor pattern 71 is printed. The third conductor pattern 71 is printed on the second nonmagnetic substance layer 69 and the exposed part of the second conductor pattern 67 (tip end portion of the second buried conductor part 31) by being overlaid thereon. The third conductor pattern 71 is formed around the second magnetic substance layer 70. The third conductor pattern 71 forms the remaining part of the second conductor 14. Therefore, the third conductor pattern 71 becomes the pattern in the shape in which four of the second conductors 14 are laterally arranged in a line and are halved. The third conductor pattern 71 becomes the pattern in which the second projecting parts 35 of the second electric conductors 14 and the first projecting parts 34 of the second electric conductors 14 are connected by the cut margin parts 72.

Figure 10B:
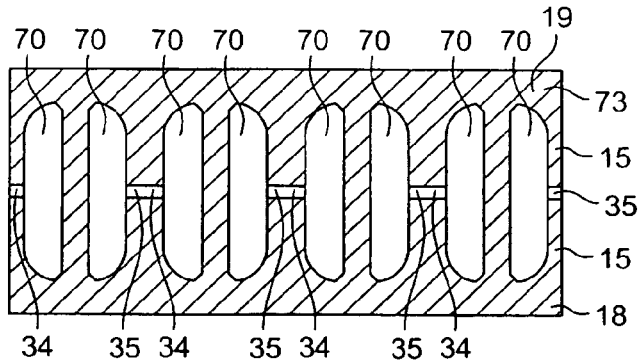

Next, as shown in FIG. 10B, a third nonmagnetic substance layer 73 is printed. The third nonmagnetic substance layer 73 is printed on the remaining parts except for the top of the second magnetic substance layer 70, and the parts from the tip end portions of the first projecting parts 34 to the tip end portions of the second projecting parts 35 of the third conductor pattern 71. This third nonmagnetic substance layer 73 becomes a part of the second inter-wiring nonmagnetic substance 15, a part of the second nonmagnetic substance 19 and a part of the first nonmagnetic substance 18.

Figure 10C:
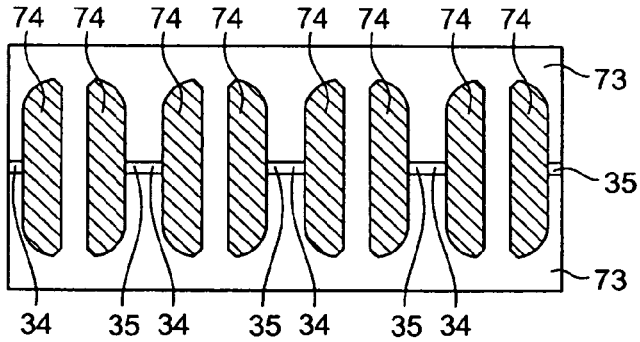

Next, as shown in FIG. 10C, a third magnetic substance layer 74 is printed on the second magnetic substance layer 70. The third magnetic substance layer 74 becomes a part of the magnetic substance 8 in the first spiral, and a part of the magnetic substance 7 in the second spiral.

As a result, in the state in which the third magnetic substance layer 74 and the third nonmagnetic substance layer 73 are printed, the third conductor pattern 71 is exposed at the parts from the tip end portions of the first projecting parts 34 and the tip end portions of the second projecting parts 35.

Figure 10D:
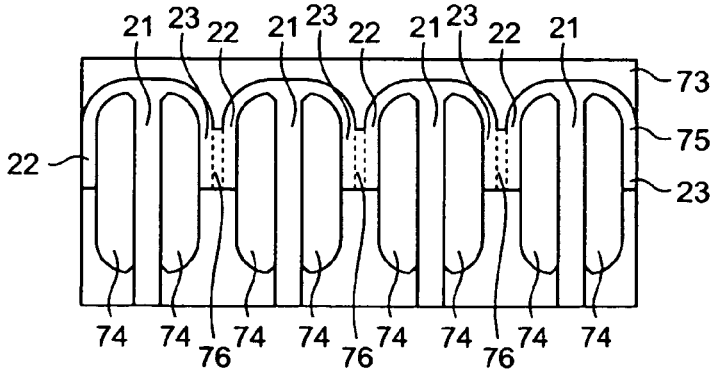

Next, as shown in FIG. 10D, a fourth conductor pattern 75 is printed. The fourth conductor pattern 75 is printed on the third nonmagnetic substance layer 73 and on the exposed parts of the third conductor pattern 71 by being overlaid on them. The fourth conductor pattern 75 is formed around the third magnetic substance layer 74. The fourth conductor pattern 75 forms the third electric conductor 16. Therefore, the fourth conductor pattern 75 becomes the pattern in the shape in which four of the anchor-shaped third electric conductors 16 are laterally arranged in a line. The fourth conductor pattern 75 becomes the pattern in which the first left branch conductor parts 22 and the first right branch conductor parts 23 of the third electric conductors 16 are connected by cut margin parts 76.

Figure 11:
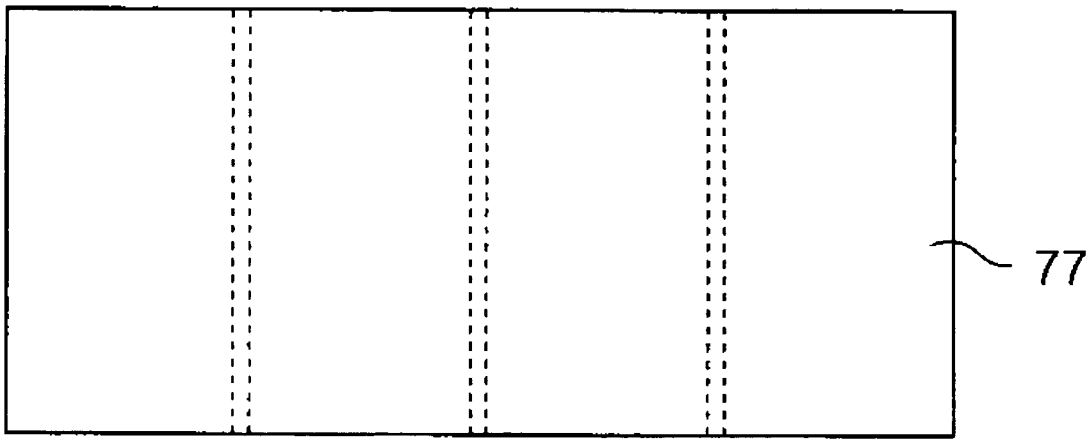
FIG. 11 is a manufacturing process diagram showing the method for manufacturing the coil main body according to the embodiment of the present invention (4)

Next, as shown in (A) in FIG. 11, a fourth magnetic substance layer 77 is printed on the fourth conductor pattern 75. The fourth magnetic substance layer 77 is printed on the entire surface of the green sheet 61. The fourth magnetic substance layer 77 becomes the covering magnetic substance 17.

After the above printing is performed on the green sheet 61, the green sheet 61 is cut at the positions shown by the broken line in FIG. 11A (the positions of the cut margins 64, 68, 72 and 76, between the branch conductor parts 22 and 23 of the adjacent two coil main bodies 1). Thereby, a plurality of (four in FIG. 11) green chips are formed. Thereafter, each of the green chips is burnt at a high temperature. Thereby, four conductor patterns 63, 67, 71 and 75, four nonmagnetic substance layers 62, 65, 69 and 73, four magnetic substance layers 66, 70, 74 and 77 are integrated with the green sheet 61 in each of the green chips.

By going through the above processes, four of the coil main bodies 1 of the surface-mount coils having the aforementioned characteristics shown in FIGS. 1 to 3 are formed.

Further, the coating layer 20 is formed on both side surfaces in the short side direction of the coil main body 1, and the first external electrode 2 and the second external electrode 3 are mounted at both end portions in the long side direction of the coil main body 1, whereby the surface-mount coil according to the aforementioned embodiment is formed.

By manufacturing the surface-mount coil according to the embodiment of the present invention by the above method, the outer peripheral part of the first electric conductor 12, the outer peripheral part of the second electric conductor 14 and the outer peripheral part of the third electric conductor 16 are surely exposed at the surface of the burnt core, in section. Accordingly, the surface-mount coil exhibits the excellent direct-current saturation characteristic. In addition, the coil main bodies 1 of a plurality of surface-mount coils are burnt at the same time, and thereby, the surface-mount coils can be efficiently manufactured.

By manufacturing the surface-mount coil by this method, even if the actual cut positions of the green sheet 61 deviates from the positions shown by the broken lines in FIG. 11A, the sizes of the cores inside the outer peripheral parts of the first electric conductors 12 or the like of the surface-mount coils formed by it are not changed. Accordingly, the inductance value of each of the surface-mount coils is maintained at the actual measured value close to the calculated value of the inductance obtained based on the size of the core in the coil. As a result, a number of surface-mount coils can be produced from one green sheet 61 while variation in the inductance value is suppressed.

The above described embodiment is an example of a preferred embodiment of the present invention, but the present invention is not limited to the above described embodiment, and various modifications and changes can be made.

In the above described embodiment, the first buried conductor part 21 is connected to the first external electrode 2, and the third buried conductor part 41 is connected to the second external electrode 3, whereby the first coil and the second coil buried in the core are connected to the first external electrode 2 and the second external electrode 3. Other than this, for example, as shown in the modified example in FIG. 12, two branch conductor parts 102 and 103 of the first electric conductor 12 may be connected to the first external electrode 2, and two branch conductor parts 82 and 83 of the third electric conductor 16 may be connected to the second external electrode 3.

Figure 12:
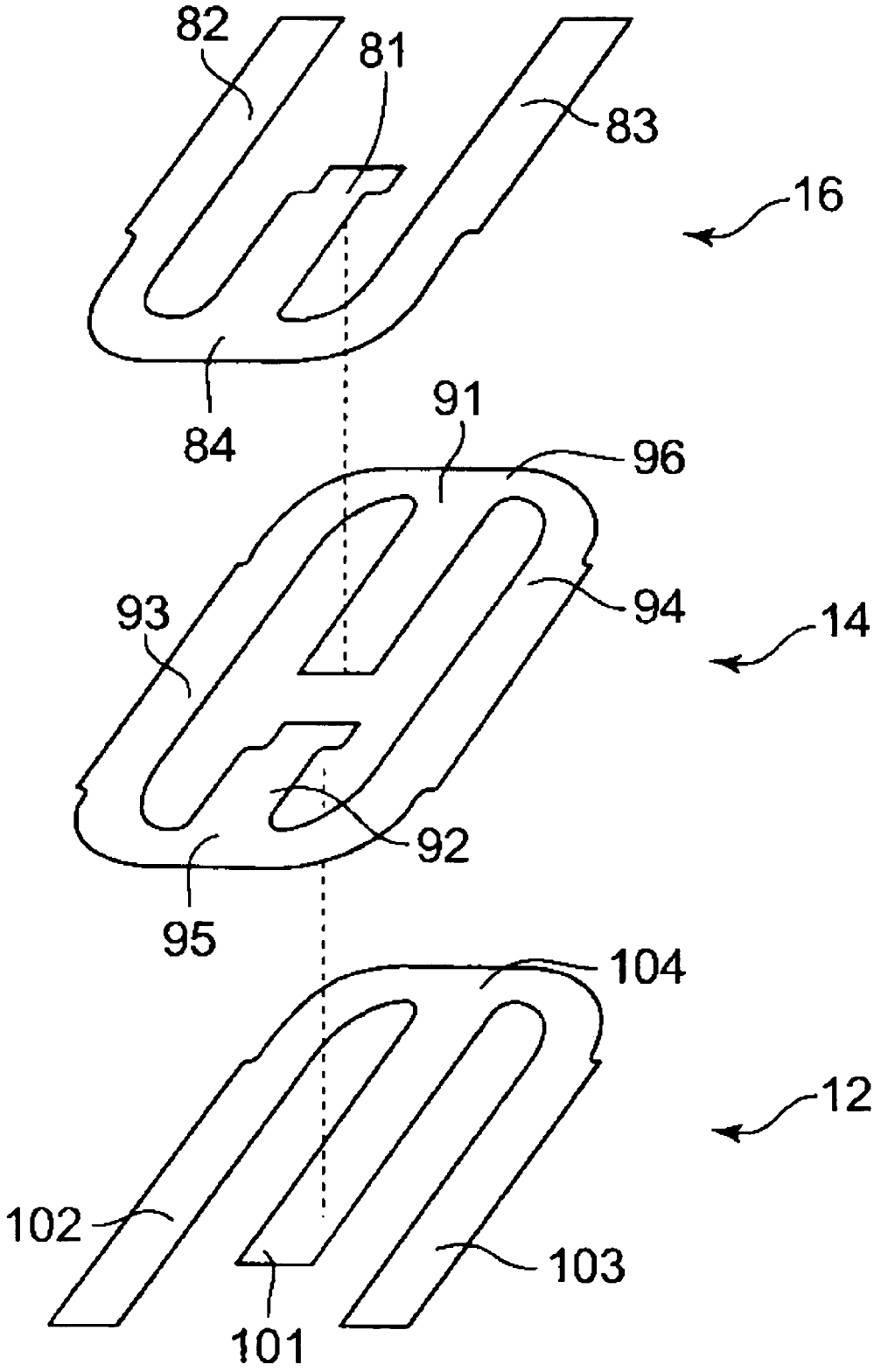
FIG. 12 is a perspective view showing a first electric conductor, a second electric conductor and a third electric conductor which are formed in a coil main body of a surface-mount coil according to a modified example.

In the case of the modified example of FIG. 12, the electric current flowing in the one branch conductor part 102 of the first electric conductor 12 flows into the one branch conductor part 82 via, for example, a fourth connecting conductor part 104 and a third buried conductor part 101 of the first electric conductor 12, one second buried conductor part 92, a second connecting conductor part 95, a branch conductor part 93, a third connecting conductor part 96 and the other second buried conductor part 91 of the second electric conductor 14, and a first buried conductor part 81 and a first connecting conductor part 84 of the third electric conductor 16.

The electric current flowing in the other branch conductor part 103 of the first electric conductor 12 flows into the other branch conductor part 83 via, for example, the fourth connecting conductor part 104 and the third buried conductor part 101 of the first electric conductor 12, the one second buried conductor part 92, the second connecting conductor part 95, the other branch conductor part 94, the third connecting conductor part 96 and the other second buried conductor part 91 of the second electric conductor 14, and the first buried conductor part 81 and the first connecting conductor part 84 of the third electric conductor 16.

The modified example shown in FIG. 12 can be also manufactured by the same method as the above described manufacturing method. In such a case, the conductor patterns, the magnetic material patterns, the nonmagnetic material patterns and the positions of the through-holes are changed in accordance with the modified example.

In the above described embodiment, the first coil and the second coil are formed into 2.5 turns in the three electric conductors which are the first electric conductor 12, the second electric conductor 14 and the third electric conductor 16. Other than this, for example, by increasing and decreasing the number of electric conductors, the first coil and the second coil may be formed into, for example, 1.5 turns, 4.5 turns and the like.

The number of coils buried in the core may be three or more instead of two coils that are the first coil and the second coil. In this case, a plurality of branch conductor parts which branch from each of the buried conductor parts may be placed in the same plane as the buried conductor part, or may be placed three-dimensionally around the buried conductor part. As for the number of coils buried in the core, an even number of coils make balance of the magnetic flux generated in the core better than an odd number of coils. However, when three or more of the coils are formed in the core, the core is divided into smaller pieces correspondingly. As a result, the volume of the core which the buried conductor part can effectively use until the core is saturated decreases. Therefore, when considering the balance of the size of the surface-mount coil and the inductance value, it is desirable to form two coils which are the first coil and the second coil in the core.

In the above described embodiment, the outer peripheral parts of the three electric conductors 12, 14 and 16 are exposed on the surface of the core in their entirety. Other than this, for example, the outer peripheral part of the electric conductor may be placed so that only a part of it is exposed at the surface of the core, or it may be placed so as not to be exposed at the surface of the core though it is placed along the surface of the core. However, if the outer peripheral part of the electric conductor is placed so that even only a part of the outer peripheral part of the electric conductor is not exposed at the core, the space between the outer peripheral part and the buried conductor part is decreased. Therefore, when the inductance value is secured by making the most of the size of the core, it is desirable that the outer peripheral part of the electric conductor is exposed on the surface of the core in its entirety.

In the above described embodiment, three-layer internal conductor is formed by the first conductor pattern 63, the second conductor pattern 67, the third conductor pattern 71 and the fourth conductor pattern 75. Other than this, for example, the internal conductor may be formed into two layers, four layers and five layers or more. In this case, a necessary number of conductor patterns and nonmagnetic material patterns are alternately layered on the main body substrate 11.

In the above described embodiment, the surface-mount coil used as the power inductor or the like is shown as an example. Other than this, for example, the surface-mount coil may be those used as an antenna of a cellular phone or the like, a choke coil, a matching coil, a boosting coil and the like. An inductance element of a type with both ends of the winding wire buried in the core projected from the core, for example, may be adopted instead of the surface-mount type.

In the above described embodiment, the electric conductor layer, the nonmagnetic layer and the magnetic layer are overlaid on the green sheet 61 by printing. The coil having the layered structure by printing like this is called a layered coil.

Other than this, for example, in the surface-mount coil, the electric conductor layer may be formed on the green sheet 61 by sputtering and the vapor deposition technique. The coil having the layered structure by sputtering and vapor deposition technique like this is called a thin film coil.

In the above described embodiment, the surface-mount coil as an inductance element is explained as an example. Other than this, with the surface-mount coil as an impedance element for a noise filter, the same effect can be expected by adopting the same structure as in the above described embodiment. However, in the case of the impedance element for the noise filter, the effect of an excellent direct-current saturation characteristic and the like can be expected without providing the non-magnetic gap substance 9 which is provided on the entire surface of the surface-mount coil.

The magnetic element according to the present invention can be used for a surface-mount coil as an inductance element for an LC filter, a surface-mount coil as an impedance element for a noise filter, and the like.

What is claimed is:

1. A magnetic element, comprising:

a coil main body having a core formed of a magnetic material;

an internal conductor having a plurality of buried conductor parts buried in a central portion of said core and a plurality of branch conductor parts branching from each of said plurality of buried conductor parts, wherein said plurality of branch conductor parts turn along the perimeter of the core wherein said plurality of branch conductor parts are exposed at a surface of said coil main body wherein a region of the branch conductor part exposed at the surface of the coil main body is covered with a nonmagnetic and nonconductive material.

2. The magnetic element as recited in claim 1, wherein each of said plurality of branch conductor parts is connected to another one of said buried conductor parts.

3. The magnetic element as recited in claim 2, further comprising:

a first external electrode placed at said coil main body;

a second external electrode placed at said coil main body; and wherein said internal conductor is connecting said first external electrode and said second external electrode so that an electric current flowing between said first external electrode and said second external electrode flows dividedly into said plurality of branch conductor parts from said buried conductor part, and flows unitedly into said another one of said buried conductor part from said plurality of branch conductor parts.

4. The magnetic element according to any one of claims 1 to 3, further comprising:

a nonmagnetic gap part formed of a nonmagnetic material, placed in contact with at least a part of said internal conductor, and formed along a direction which blocks a magnetic flux generated when electric current flows into said magnetic element.

5. The magnetic element according to any one of claims 1 to 3, wherein said internal conductor forms a spiral in said coil main body and has a nonmagnetic inter-conductor nonmagnetic part placed between conductors that are parallel in the spiral.

6. The magnetic element according to any one of claims 1 to 3, wherein one end portion of said internal conductor is connected to said first external electrode, and the other end portion of said internal conductor is connected to said second external electrode; and nonmagnetic parts formed of a nonmagnetic material placed between one portion of said internal conductor and said first external electrode and between the other portion of said internal conductor and said second external electrode.

7. The magnetic element according to any one of claims 1 to 3 wherein a width of said plurality of buried conductor part is more than double the width of the plurality of branch conductor parts.

* * * * *